US012383033B2

(12) United States Patent
Veenstra

(10) Patent No.: US 12,383,033 B2
(45) Date of Patent: Aug. 12, 2025

(54) WALKING CANE HANGER

(71) Applicant: Joan A. Veenstra, Novi, MI (US)

(72) Inventor: Joan A. Veenstra, Novi, MI (US)

( * ) Notice: Subject to any disclaimer, the term of this patent is extended or adjusted under 35 U.S.C. 154(b) by 0 days.

(21) Appl. No.: 18/132,767

(22) Filed: Apr. 10, 2023

(65) Prior Publication Data

US 2024/0130491 A1 Apr. 25, 2024
US 2024/0225215 A9 Jul. 11, 2024

Related U.S. Application Data

(63) Continuation-in-part of application No. 17/972,126, filed on Oct. 24, 2022.

(51) Int. Cl.
*A45B 1/04* (2006.01)

(52) U.S. Cl.
CPC ..... *A45B 1/04* (2013.01)

(58) Field of Classification Search
CPC ..... A45B 1/04
See application file for complete search history.

(56) References Cited

U.S. PATENT DOCUMENTS

| | | | |
|---|---|---|---|
| 4,300,742 | A | 11/1981 | Hunn |
| 4,794,743 | A | 1/1989 | Lehneis |
| 4,895,330 | A | 1/1990 | Anstead |
| 5,000,418 | A | 3/1991 | Vogt |
| 5,456,437 | A | 10/1995 | Chander |
| 11,344,088 | B1 | 5/2022 | Bowens |
| 2009/0145470 | A1 | 6/2009 | Couper |
| 2011/0017901 | A1 | 1/2011 | Denburg |

FOREIGN PATENT DOCUMENTS

| | | | |
|---|---|---|---|
| GB | 2326590 | A | 12/1998 |

*Primary Examiner* — Noah Chandler Hawk
(74) *Attorney, Agent, or Firm* — Gunther J. Evanina; BUTZEL LONG

(57) ABSTRACT

A cane hanger adapted to stably support a walking cane on a horizontal surface includes a body having a base attachable to a side of a walking cane, a beam projecting away from the base, a leg depending from a distal end of the beam, and a support engagement surface either at a bottom of the leg or located on a foot pivotably attached to a distal end of the leg.

1 Claim, 4 Drawing Sheets

WALKING CANE HANGER

CROSS-REFERENCE TO RELATED APPLICATIONS

This application is a continuation-in-part of U.S. application Ser. No. 17/972,126 filed on Oct. 24, 2022 which is incorporated herein by reference in its entirety.

FIELD OF THE DISCLOSURE

This disclosure relates to walking canes that can be stably supported on a flat horizontal surface such as a tabletop, countertop or appliance top, and to a walking cane accessory to facilitate stable support of the walking cane on a flat horizontal surface.

BACKGROUND OF THE DISCLOSURE

Known devices for supporting a walking cane at the top of a counter or table have generally included a base or clamp for either permanently or releasably attaching a walking cane holding device to a walking cane, and a clip, grapple, or the like for engaging a surface of a counter, tabletop or other work surface. While some of these devices perform adequately, there remains a need for a walking cane hanger that is easy to use while exhibiting improved stability when supporting a cane at the edge of a tabletop, countertop, household appliance top or the like.

SUMMARY OF THE DISCLOSURE

A walking cane hanger in accordance with this disclosure includes a hanger body having a base configured for attachment to a side of a walking cane, a beam extending laterally away from the base and cane, a leg extending downwardly from the beam, and a support engagement surface at a distal end of the leg or at a bottom of a foot pivotably attached to a distal end of the leg. The engagement surface has a substantially flat exposed surface for frictionally engaging a tabletop or other horizontal surface.

DETAILED DESCRIPTION OF THE ILLUSTRATED EMBODIMENTS

Figure 1:
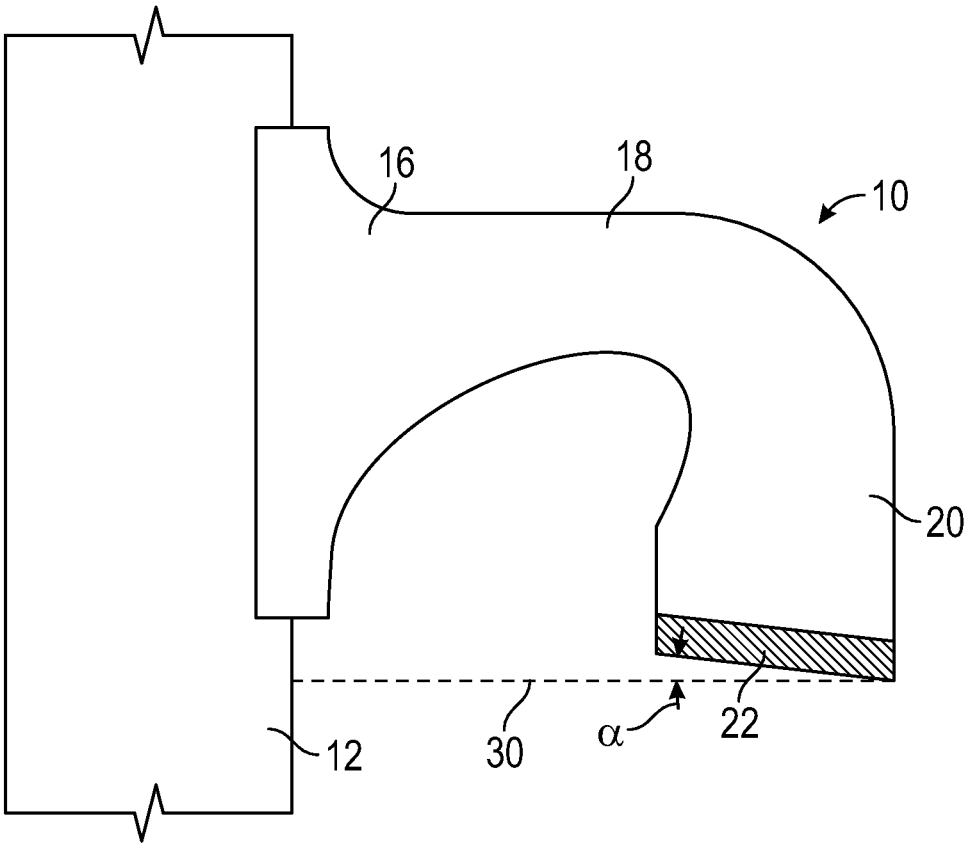
FIG. 1 is a side view of a walking cane hanging device in accordance with this disclosure.
Figure 2:
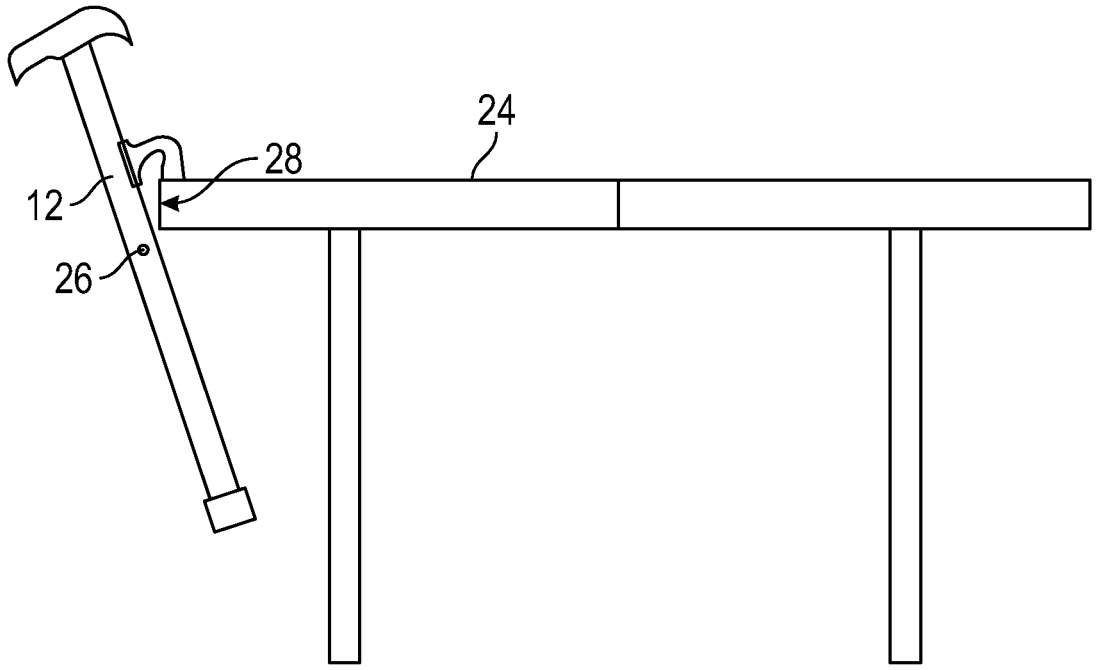
FIG. 2 is a side view of a walking cane with the disclosed hanging device used to support a walking cane in free balance on a tabletop.
Figure 3:
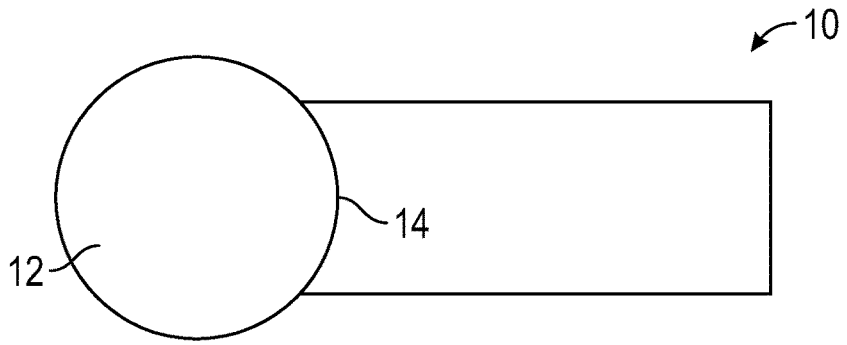
FIG. 3 is a top view of the hanging device shown in FIG. 1.

Shown in FIGS. 1-3 is a first embodiment of walking cane hanger 10 attached to a walking cane 12. Hanger 10 includes a body having a base configured for attachment to cane 12. In the illustrated embodiment of FIG. 1, hanger 10 has a circular curved section 14 that conform with the outer surface of cane 12 having a circular cross-sectional profile. It is possible that hanger 10 can be formed integrally with cane 12. However, it can also be manufactured separately as an add-on accessory that can be attached to a cane 12, such as with an adhesive, screws, or a combination of mechanical fasteners, such as dowels used with an adhesive material.

The body of hanger 10 includes a base portion 16 (the portion attached directly to cane 12), a beam portion 18 that projects laterally (outwardly and away from base portion 16), and a leg portion 20 that extends downwardly (i.e., depends) from an end of beam 18 that is distal from cane 12. The base 16, beam 18 and leg 20 are integral parts of a one-piece body, and are not hinged or articulated with respect to each other. However, the base, beam and leg can be fabricated together or as separate parts that are fixed together. The base portion 16 has a cane engaging surface contoured to continuously abut a portion of a side of a cane along a portion of the length of the cane.

In the embodiment shown in FIG. 1, a support engagement surface 22 is located at a bottom of leg 20. Surface 22 is substantially flat and configured for frictionally engaging a flat horizontal support surface (such as tabletop 24, shown in FIG. 2). Surface 22 is or preferably includes a gripping pad that is soft and non-abrasive to facilitate gripping (i.e., frictional engagement with tabletop 24) without scratching or otherwise marring the top surface 24. Surface 22 can comprise a rubber pad adhesively bonded to hanger 10 or a rubber coating applied to the bottom of leg 20. While the exposed surface 22 engaging tabletop 24 is substantially flat (i.e., planar), it can be provided with bumps, knurls, treads, or other patterned surface irregulations to enhance frictional engagement with a support surface (e.g., tabletop 24).

In order to more stably support cane 12 on a horizontal support surface (e.g., tabletop 24), the center-of-mass 26 of cane 12 is located approximately below an edge 28 of tabletop 24, with a lower portion of cane 12 slanting toward and beneath the tabletop 24. This is achieved by providing hanger 10 with an engagement surface 22 that is inclined (i.e., at an angle relative to a plane 30) that is normal (perpendicular) to the main length of cane 12. The angle of inclination (a) can be about 5 degrees to about 15 degrees. A preferred angle is about 11 degrees (e.g., 6 to 10 degrees).

Figure 4:
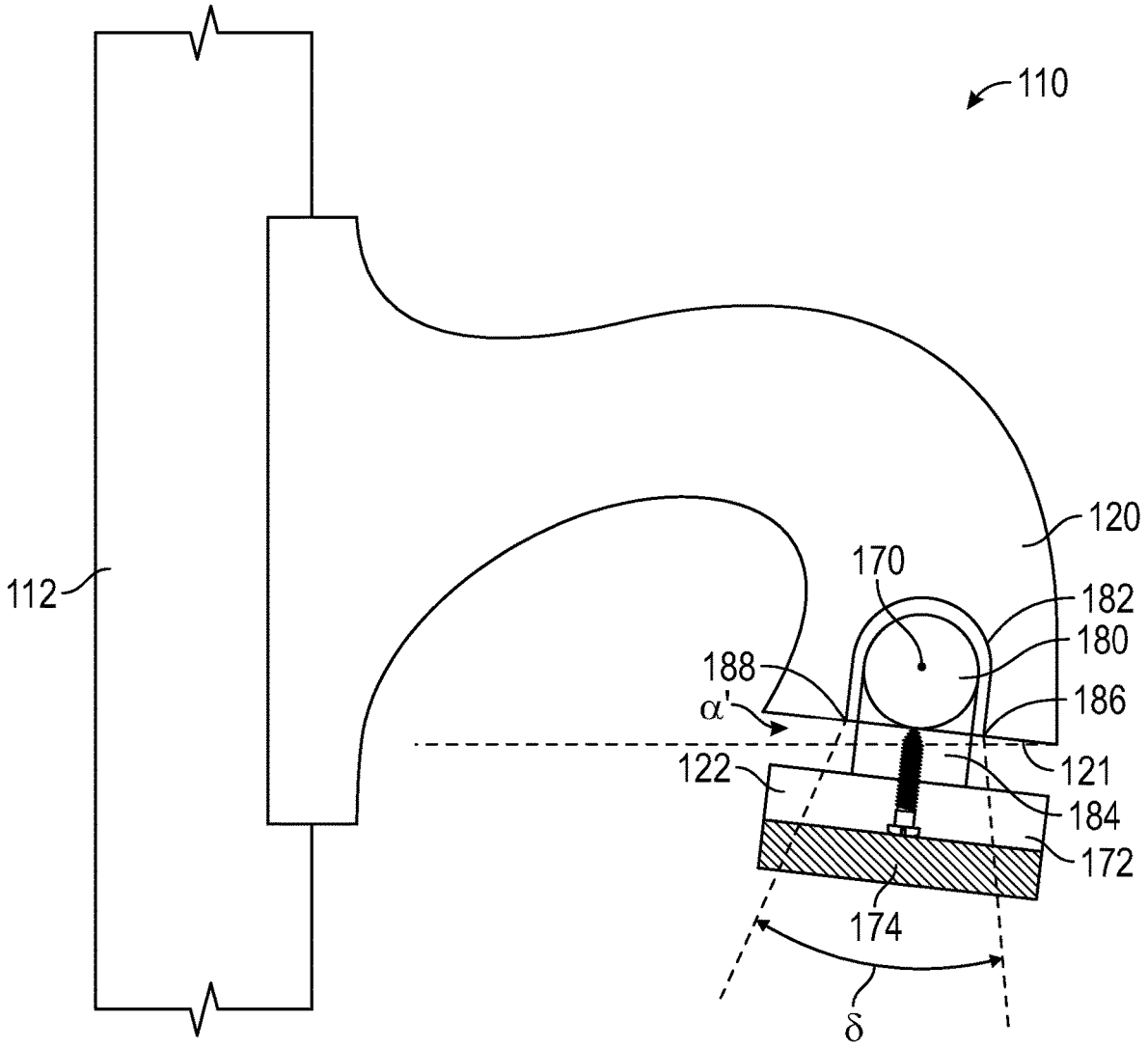
FIG. 4 is a side view in partial cross-section of another embodiment of a walking cane hanging device having a pivoting foot in accordance with an aspect of this disclosure.
Figure 5:
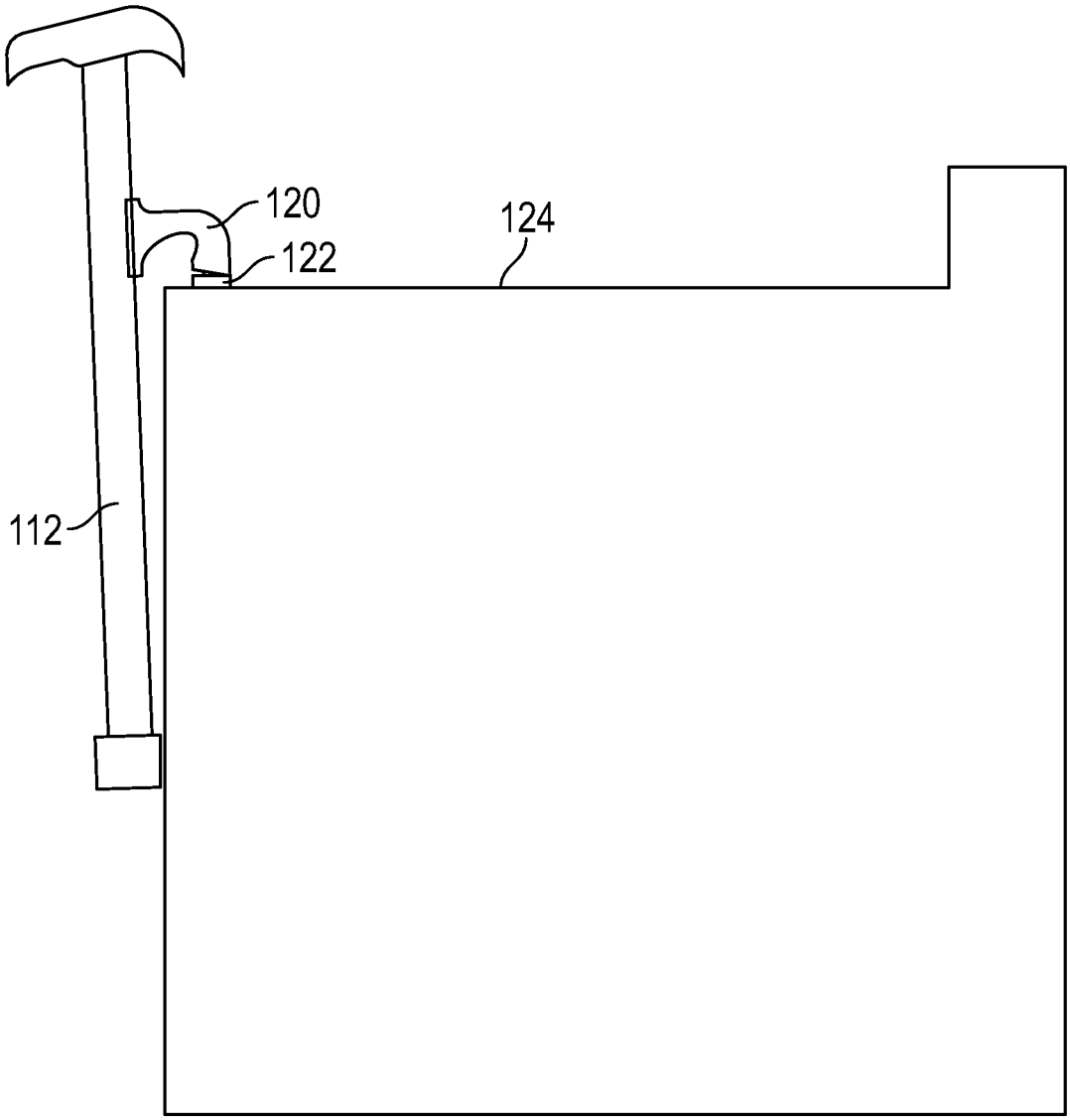
FIG. 5 is a side view of a walking cane with the disclosed hanging device having a pivotably attached foot used to support a walking cane on a support surface in which space below the support surface is generally inaccessible.

An alternative embodiment 110 is shown in FIGS. 4 and 5. Hanger 110 is generally similar to hanger 10, except that it includes a foot 122 that is pivotably attached to leg 120 at pivot axis 170. Foot 122 can include a foot base layer 172 and a gripping layer 174 that can be attached to the bottom surface of base layer 172 or coated on to the bottom surface of base layer 172. As with surface 22, the grip layer 174 can be made of rubber, preferably a soft, non-abrasive rubber material, and can be provided with a gripping relief pattern comprising nubs, knurls, treads or the like. The pivot is preferably configured to allow rotation of the substantially flat bottom surface of foot 122 relative to leg 120 through an angle (δ) of about 20 degrees to about 30 degrees. A preferred angle (δ) is about 20 degrees (e.g., 17 degrees to 25 degrees). The pivotability of foot 122 relative to leg 120 allows the cane to be supported, with complete stability, on a horizontal surface of an object such as washing machine 124 that does not allow the cane to swing freely below the top surface. It can also allow greater flexibility in positioning of hanger 110 along the length of the cane, such as to accommodate a particularly heavy knob or top of the cane, while maintaining stable support of the cane on a horizontal support surface. Pivot axis 170 can be a modified ball and socket arrangement in which sides of the ball normal to the pivot axis are flattened to limit rotation of the foot relative to the leg in a single plane.

As with hanger 10, the distal end of leg 120 has an exposed surface 121 that is substantially flat and inclined at an angle ($\alpha'$) which can be about 5-20 degrees, preferably about 11 degrees (e.g., 5 to 15 degrees).

Hangers 10 and 110 can be sold separately as an after-market accessory or can be pre-attached or integrated to a cane. The walking cane hanger can be generally made of wood, plastic or other suitable materials, with the optional foot pad or coating 22, 174 made of rubber or other soft, non-abrasive gripping material.

As can be seen in reference to FIG. 4, the pivot for foot 122 can include a pivot barrel 180 located within a conforming recess 182 at a bottom of leg 120. Recess 182 is configured so that stem 184 is engageable with edges 186, 188 of recess 182 to limit or allow about 20 to about 30 degrees of rotation.

Figure 6:
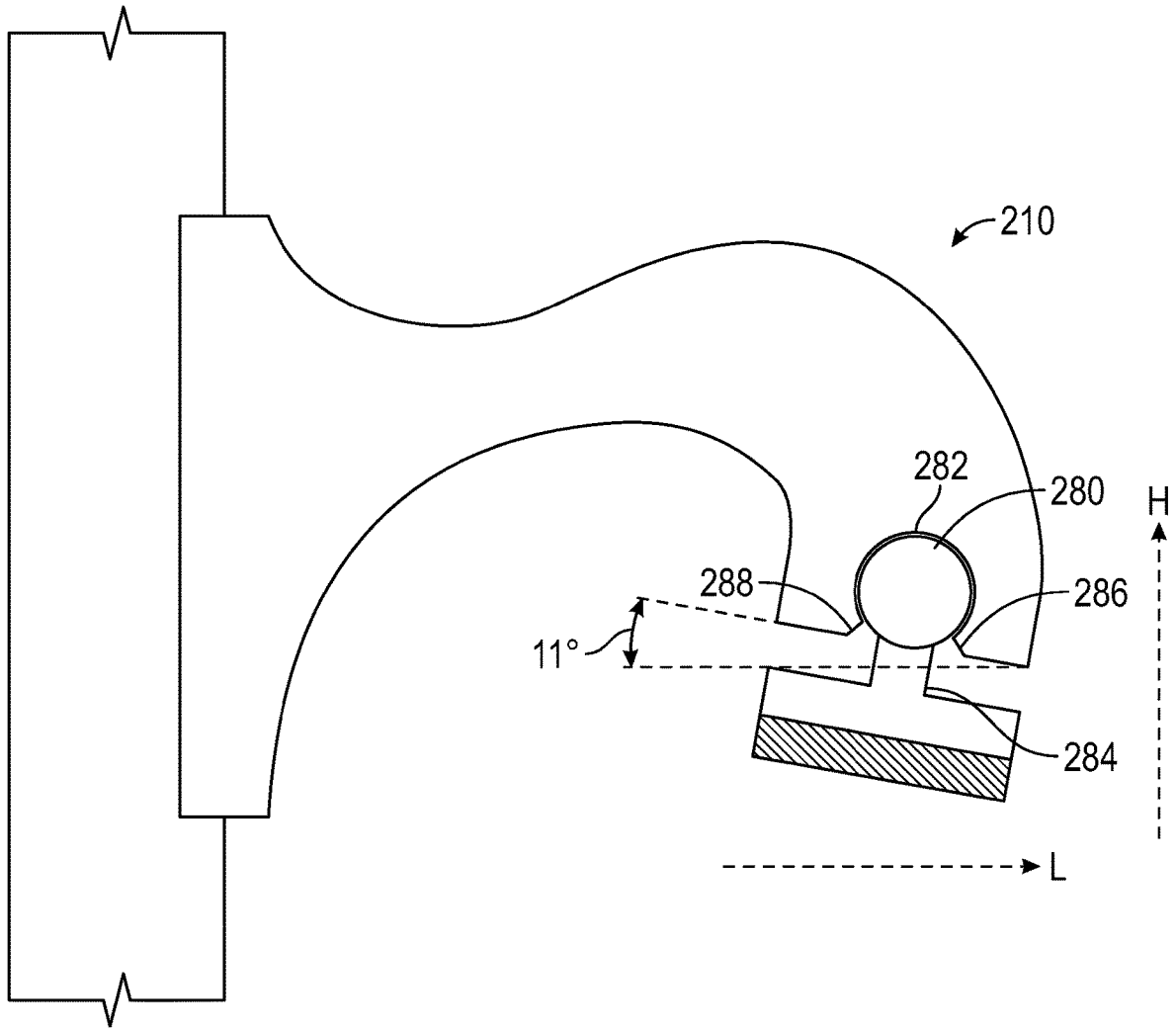
FIG. 6 is a side view in partial cross-section of another embodiment of a walking cane hanging device having a pivoting foot with a pivot barrel captured in a recess in accordance with another aspect of this disclosure.

Shown in FIG. 6 is a slightly modified embodiment 210, similar to that shown in FIG. 4, in which the pivot barrel 280 is cylindrical and the recess 282 in which the barrel 280 is received has a key-hole shape configured to capture barrel 280. As with the embodiment shown in FIG. 4, recess 282 has inclined surfaces 286, 288 that engage stem 284 to limit or allow about 20 to about 30 degrees of rotation.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

The invention claimed is:

1. A walking cane hanger, comprising:

a base having a cane engagement surface contoured to continuously abut a side surface of a walking cane;

a beam projecting laterally away from the base;

a leg extending downwardly from an end of the beam that is distal of the cane engagement surface, wherein the base, the beam, and the leg are integral parts of a one-piece body, and are not hinged or articulated with respect to each other; and a foot pivotably attached to the leg, the foot including a pivot barrel located within a conforming recess at a bottom of the leg, and a substantially flat exposed surface for frictionally engaging a horizontal support surface wherein the recess has a key-hole shape in which the pivot barrel is captured.

* * * * *